United States Patent [19]

Weder et al.

[11] 4,216,620

[45] Aug. 12, 1980

[54] FLOWER POT WRAP WITH LACE PATTERN EDGING

[75] Inventors: Erwin H. Weder, Highland, Ill.; Donald E. Weder, Hobart, Okla.

[73] Assignee: Highland Supply Corporation, Highland, Ill.

[21] Appl. No.: 746,635

[22] Filed: Dec. 1, 1976

[51] Int. Cl.[2] ..... B65D 65/10, B65D 65/18

[52] U.S. Cl. ..... 47/72; 150/52 R; 206/423; 229/3.5 MF; 229/87

[58] Field of Search ..... 229/87 R, 3.5 MF, 87 P, 229/89; 206/423; 150/52 R; 47/72; D9/259, 260; D59/1, 2 R, 2 B, 2 C

[56] References Cited

U.S. PATENT DOCUMENTS

| | | | |
|---|---|---|---|
| 239,987 | 4/1881 | Shellenberger | 229/89 |
| 1,421,027 | 6/1922 | Reynolds | 229/87 R |
| 1,446,563 | 2/1923 | Hughes | 206/423 |
| 1,920,533 | 8/1933 | Strauss | 229/87 R X |
| 2,076,212 | 4/1937 | Suter et al. | 229/3.5 MF |
| 2,302,259 | 11/1942 | Rothfuss | 150/52 R |
| 3,013,689 | 12/1961 | Shropshire | 229/3.5 MF X |

FOREIGN PATENT DOCUMENTS

| | | | |
|---|---|---|---|
| 161005 | 4/1933 | Switzerland | 47/72 |

*Primary Examiner*—Stephen P. Garbe

*Attorney, Agent, or Firm*—Clarence A. O'Brien; Harvey B. Jacobson

[57] ABSTRACT

A wrap for flower pots for use by florists and the like having a central portion of metallic foil with a lace pattern edging extending from at least one of the edges of said foil and possibly from both edges. Normally, the lace pattern edging will be provided on a layer of plastic which is of greater dimension in at least one direction than the metallic foil to which it is adhered. The lace pattern may be printed or embossed upon the plastic material while the metallic foil material may be in various colors. The foil to film lamination may be embossed or creped. The wrap offers a quick and economical material for greatly increasing the appearance and attractiveness of conventional type flower pots.

5 Claims, 7 Drawing Figures

Fig. 1
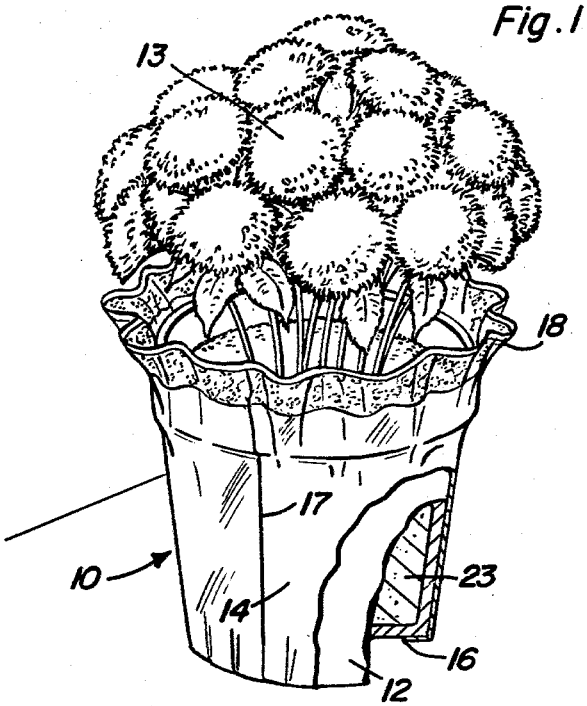
Fig. 6
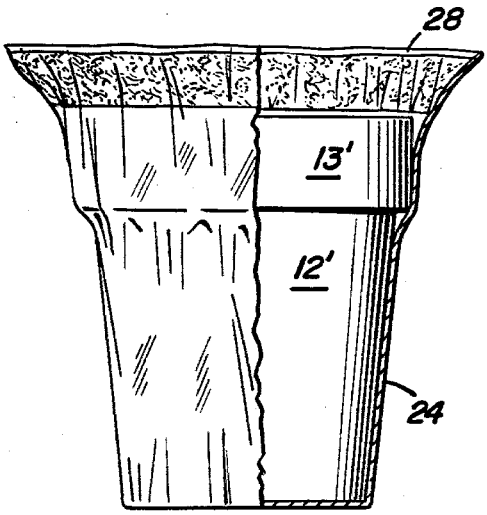
Fig. 2
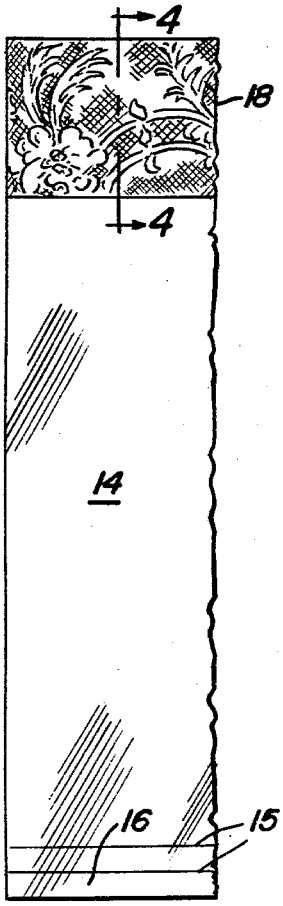
Fig. 3 Reverse Side
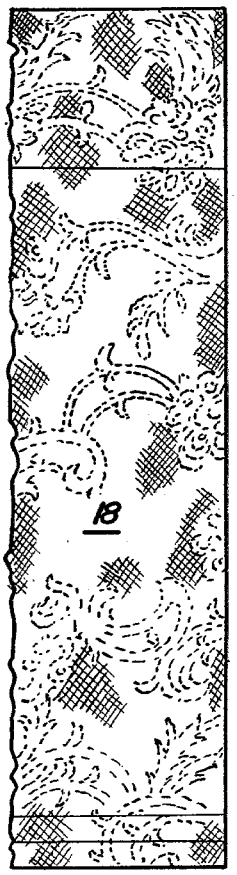
Fig. 4
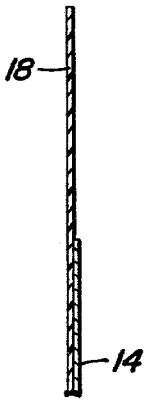
Fig. 5
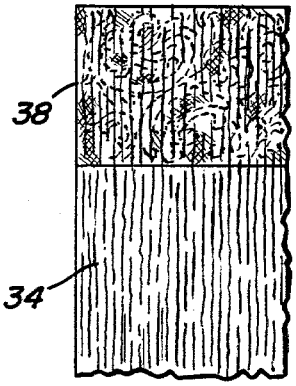
Fig. 7
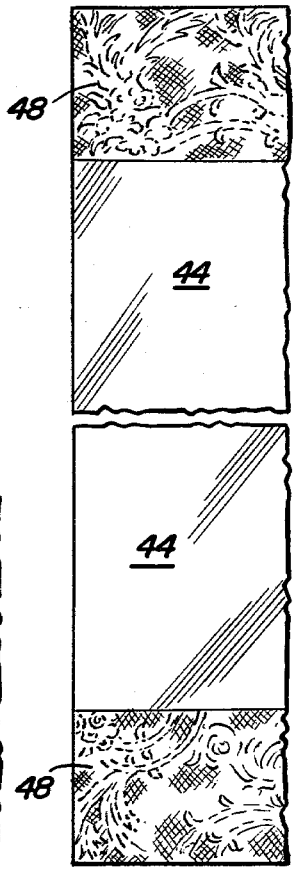

FLOWER POT WRAP WITH LACE PATTERN EDGING

BACKGROUND OF THE INVENTION

1. Field of the Invention

This invention relates generally to devices for use by florists to increase the attractiveness and improve the appearance of flower pots to be sold and distributed. It also serves as a protective cover to prevent water from the flower pot from damaging the surface the pot rests on.

2. Description of the Prior Art

A common problem with known type devices for improving the appearance of flower pots and other containers for growing flowers is that the devices normally are rather awkward to apply, rather time consuming in application and relatively expensive. Also, the flexibility as to different types of applications is often limited.

Another problem with known type materials and devices for improving the appearance of flower pots and other containers holding growing flowers is that most of these devices are not readily adaptable for different sizes of pots and containers. Thus, a number of various sizes of the devices must be available in order to fit the range of containers which a florist normally has on hand. This greatly increases the necessary inventory and obviously the cost.

None of the known prior art devices offers the new and unique features of the invention disclosed herein.

SUMMARY OF THE INVENTION

An object of the present invention is to provide a flower pot wrap with lace pattern edging which will quickly, easily, and inexpensively greatly improve the appearance of flower pots and other containers to which it is applied.

Another object of the present invention is to provide a wrap for flower pots and other containers of similar nature which has a metallic foil for positively retaining the wrap as formed about the container while also having an edging along at least one edge of the metallic foil which has a lace pattern effect thereon.

A further object of this invention is to provide a material for wrapping boxes and containers which includes a metallic foil which may be silver in color or in various other colors, together with a plastic material firmly attached to the metallic foil and extending outwardly therefrom along at least one of the edges of the foil and having a lace pattern design on the plastic material. The lace pattern may be applied by printing, silk screening, embossing or creping.

A still further object of this invention is to provide a wrap for containers having a portion made of metallic material with another portion of plastic with the plastic extending outwardly of the edges of the metallic material up to all four sides thereof, and with a lace pattern associated with the plastic material. Also, both the plastic and metallic material are creped to represent a pleasing crinkled surface to both materials.

An additional further object of this invention is to provide a sheet of metallic material firmly adhered to a larger sheet of plastic material with both of the materials being embossed with a design or pattern so as to present an attractive appearance to the overall composition wrap.

Another further object of this invention is to provide an elongated sheet of metallic material of various colors adhered firmly to a larger sheet of plastic material with the plastic extending outwardly along one or more elongated edges of the metallic material and with a lace pattern design associated with the edging of the plastic material which extends beyond the metallic material. The opposite parallel edges of both materials are also provided with guide lines for aiding the user of the wrap in installing same in a proper aligned manner.

The wrap for flower pots and other containers with lace pattern edging as disclosed herein offers a number of new and unique features not heretofore found in the art. The wrap basically consists of an elongated sheet of metallic foil having securely adhered thereto a somewhat larger sheet of plastic material with the plastic material having associated therewith a lace pattern design. If the plastic side of the combination wrap is applied against the flower pot, then the attractive appearance of the metallic foil will substantially cover the greater portion of the pot with the lace pattern edging extending thereabove to create an attractive border surrounding the top of the pot and the base of the growing flowers. Or, the wrap may be applied with the plastic on the outside and thus create a two-part pattern effect with the upper portion being transparent and relatively clear except for the pattern while the lower portion which substantially covers the pot itself permits the attractive foil color, either its natural color or as changed by various color processes, to shine or be seen through the pattern design on the transparent plastic surface.

When the plastic edging extends from only one side of the metallic foil, guide lines may be applied by printing, inscribing, embossing or the like along the other edge to function as an alignment guide for the user of the wrap.

In addition to having the foils in either silver or various colors, the combination foil and plastic may be provided with a number of irregular surfaces such as by creping or embossing. Also, the plastic material may extend beyond two of the sides of the metallic foil, three of said sides, or even all four sides. Thus, the wrap may be manufactured, distributed, and sold in various sizes, widths and combinations in order to present a complete range of wraps for florists and similar business establishments.

This wrap permits such users to quickly and easily greatly improve the outward appearance of flower pots and other containers for growing flowers and the like. It substantially reduces the installation time while greatly adding to the saleability of the product. It may be quickly applied and once applied will hold its shape and stay upon the container to which it is applied without additional restraining or attaching devices.

While it is known to apply metallic foil and metallic foil laminated to plastic to flower pots and the like to increase the attractiveness thereof, normally just a single piece of foil or foil laminated to undecorated plastic of the same size is used and does not have the greatly improved appearance of the material of this invention.

These, together with other objects and advantages which will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the wrap with lace pattern edging of this invention as applied to a flower pot.

FIG. 2 is a plan view of the portion of single edge lace pattern wrap.

FIG. 3 is a reverse plan view of the material shown in FIG. 2.

FIG. 4 is a fragmentary cross-sectional view taken generally along line 4—4 of FIG. 2.

FIG. 5 is a fragmentary corner portion of a modified embodiment of the invention.

FIG. 6 is a side elevational view, partly in cross section, of another embodiment of the invention.

FIG. 7 is a plan view of a double edge lace pattern embodiment with embossing thereon.

DESCRIPTION OF THE PREFERRED EMBODIMENT

Referring to FIG. 1 of the drawings, reference numeral 10 indicates in general the wrap with lace pattern edging as applied to a conventional type flower pot having growing flowers extending upward therefrom. As seen in this view, the flower pot 12 contains soil 23 therein for supporting the growing flowers 13. The wrap 10 having a lace pattern edging 18 is shown applied with the edges or ends of the material overlapping at the line indicated by reference numeral 17. The bottom edge of the material, in this case the edge which is parallel to the lace pattern edge 18, is indicated by reference numeral 16 and is bent under the bottom of the flower pot.

Looking at FIGS. 2, 3 and 4, the basic components of the overall wrap will be described in detail. A good portion of the wrap consists of a metallic foil 14 which normally will be provided in various lengths together with a plastic which may be of polyethylene or polypropylene or other suitable plastic film firmly adhered to the one side of the metallic foil. The plastic is normally provided with a pattern design or lace edging as shown in FIG. 3 for the reverse side of the material. This plastic 18 with lace pattern associated therewith greatly improves the overall appearance of the wrap and is substantially much more attractive than just the metallic foil 14 by itself. The plastic material 18 may be provided with the lace pattern by silk screening, conventional type printing processes, or the pattern may be applied by embossing. Also, the plastic may be creped to provide an additional attractive appearance effect thereto. If the lace pattern edging extends outwardly along only one of the edges of the foil, the other parallel edge thereof may be provided with guide lines 15 for aiding the user of the material in the proper alignment of the wrap as it is being applied to the flower pot.

The wrap as described may also be applied with the transparent plastic portion 18 on the outside of the pot with the metallic foil between the plastic and the pot. This will allow the attractive normal silver appearance of the foil to be seen through the pattern of the transparent plastic as can be best envisioned by viewing FIG. 3, or if the foil is in various colors, which is also envisioned by this invention, the attractive color will be seen through the pattern effect of the transparent plastic.

Another embodiment of this invention is shown in FIG. 5 wherein both the transparent plastic with the lace pattern effect thereto together with the metallic foil as firmly adhered to the plastic are creped to create a ripple and an otherwise attractive three-dimensional effect to the overall wrap. Instead of creping the combination material, embossing may be used to present a somewhat similar attractive three-dimensional effect.

FIG. 6 shows a piece of square wrap having the lace edging extending from all four sides of the metallic support material so that the pot or container will be completely enclosed within the overall wrap. As seen in this Figure, a pot 12' with a top edge 13' is set upon the center of the square piece of wrap and then the wrap 24 is brought up around the pot from all sides thereof and pressed inwardly by hand, or by machine in some possible applications, to completely encompass the pot and permit the lace pattern edging which extends from the four sides of the wrap to project upwardly and surround the top of the pot as seen at 28 in the view. Obviously such square sheets of wrap material may be automatically fed to a wrapping station and at this station additional machinery may perform the normally hand operation of bringing the wrap up and around the pot to completely encompass same as shown.

FIG. 7 shows a further embodiment of this invention wherein the lace pattern edging extends from the two longitudinally extending edges of the metallic foil 44 as at 48 and the lace pattern effect of the metallic foil is applied by embossing. This embossing of the material creates a three-dimensioned lace pattern effect which is permanent with the material and cannot easily be removed or erased.

Again, it should be emphasized that the foil and plastic either separately or together may be creped or embossed as well as being of different colors and different patterns.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A flower pot wrap comprising a planar panel of flexible, shape sustaining metallic foil and a planar panel of flexible, non-shape sustaining plastic film laminated to said metallic foil panel whereby the pot wrap becomes shape sustaining for positioning on the exterior of a flower pot with the shape sustaining characteristics thereof maintaining the pot wrap in position on the pot with an edge portion of the wrap generally aligned with the edge of the pot, said plastic film including a lace pattern edge portion extending beyond the edge portion of the metallic foil for defining a lace pattern collar above the top edge of the flower pot and below blooms on the flowers in the pot to enhance the appearance thereof.

2. The structure as defined in claim 1, wherein said pot wrap is generally square in configuration with the lace pattern edge portion being positioned along at least opposite edges of the wrap whereby the central area of the pot wrap covers the bottom of the pot and the opposed edges with the lace pattern thereon is positioned upwardly along the peripheral wall of the pot in completely enclosing relation with the lace pattern being continuous around the top edge of the pot and extending above the top edge of the pot.

3. The structure as defined in claim 1, wherein said pot wrap is generally rectangular with the lace pattern edge portion extending beyond only one longitudinal edge of the wrap, the width of the wrap being slightly longer than the vertical dimension of the pot so that when the pot wrap is positioned around the periphery of a pot, the lace pattern edge portion will extend above the top edge of the pot and the other longitudinal edge portion of the pot wrap will be folded under the periphery of the bottom of the pot.

4. The structure as defined in claim 1, wherein said metallic foil and plastic film are creped to provide a crinkled decorative appearance to the pot wrap.

5. The structure as defined in claim 1, wherein said plastic film is substantially transparent with opaque portions defining the lace pattern with the lace pattern being continuous throughout the area of the lace film to provide a lace pattern to one surface of the metallic foil, thereby enabling the pot wrap to be placed on the pot with either surface of the top wrap disposed to the exterior.

* * * * *